US008888931B2

(12) United States Patent
Watson et al.

(10) Patent No.: US 8,888,931 B2
(45) Date of Patent: Nov. 18, 2014

(54) DISHWASHER PUMP INLET MACERATOR SYSTEM

(75) Inventors: Eric Watson, Crestwood, KY (US); Errin Gnadinger, Louisville, KY (US); Meher Prasadu Kollipara, Louisville, KY (US)

(73) Assignee: General Electric Company, Schenectady, NY (US)

( * ) Notice: Subject to any disclaimer, the term of this patent is extended or adjusted under 35 U.S.C. 154(b) by 975 days.

(21) Appl. No.: 12/967,808

(22) Filed: Dec. 14, 2010

(65) Prior Publication Data

US 2012/0145203 A1 Jun. 14, 2012

(51) Int. Cl.
*B08B 3/00* (2006.01)
*A47L 15/42* (2006.01)

(52) U.S. Cl.
CPC ..... *A47L 15/4227* (2013.01); *A47L 15/4204* (2013.01)
USPC ..... 134/115 G; 134/56 D; 134/57 D; 134/58 D; 134/110

(58) Field of Classification Search
USPC ..... 134/56 D, 57 D, 58 D, 110, 115 R, 115 G
See application file for complete search history.

(56) References Cited

U.S. PATENT DOCUMENTS

| | | | | |
|---|---|---|---|---|
| 6,454,872 | B1 | 9/2002 | Miller et al. | |
| 2006/0054198 | A1 * | 3/2006 | Choi | 134/56 D |
| 2006/0162744 | A1 | 7/2006 | Walkden | |
| 2006/0174918 | A1 * | 8/2006 | Hedstrom et al. | 134/25.2 |
| 2006/0174925 | A1 * | 8/2006 | Elick et al. | 134/184 |
| 2006/0237035 | A1 * | 10/2006 | Ferguson et al. | 134/10 |
| 2007/0006899 | A1 * | 1/2007 | Bang | 134/18 |
| 2007/0235063 | A1 * | 10/2007 | Lee et al. | 134/25.2 |
| 2008/0011335 | A1 * | 1/2008 | Kim et al. | 134/104.4 |
| 2008/0072934 | A1 * | 3/2008 | Pyo et al. | 134/104.1 |
| 2008/0072936 | A1 * | 3/2008 | Pyo et al. | 134/104.4 |
| 2008/0149148 | A1 * | 6/2008 | Woo et al. | 134/104.1 |

FOREIGN PATENT DOCUMENTS

| | | |
|---|---|---|
| EP | 1057445 | 12/2000 |

* cited by examiner

*Primary Examiner* — Michael Barr
*Assistant Examiner* — Benjamin L Osterhout
(74) *Attorney, Agent, or Firm* — Dority & Manning, PA

(57) ABSTRACT

A dishwasher is provided having a wash chamber that is supplied with wash water by a water circulation pump assembly. The pump assembly has a motor, an inlet in fluid communication with a sump, and an outlet in fluid communication with the wash chamber. A macerator system is configured with the pump assembly and includes a filter screen disposed across the inlet and a chopper blade rotationally driven by the pump assembly at a defined axial distance upstream from the filter screen. The chopper blade is biased by materials in magnetic flux communication to the defined axial distance so as to maintain the defined distance in a running and stopped states of the pump assembly.

10 Claims, 4 Drawing Sheets

DISHWASHER PUMP INLET MACERATOR SYSTEM

FIELD OF THE INVENTION

The present subject matter relates generally to dishwashers, and more particularly to a dishwasher macerator system.

BACKGROUND OF THE INVENTION

Dishwashers generally include a macerator system having a rotating chopper blade adjacent to a filter screen to pulverize and break down relatively large food particles to a size that allows the particles to pass through the filter screen. This system is needed to prevent the food particles from clogging the relatively small spray arm jet holes in the wash system upstream of the pump, particularly in the event of a malfunction of the dishwasher's filtration system. For example, large food particles may enter into the pump inlet if the consumer has not fully and properly placed the manual filter assembly back into the unit after removal for cleaning or other maintenance, or because of improperly assembled or defective filter components.

The size of the holes in the filter screen and axial spacing between the filter screen and chopper blade are thus important considerations in the proper operation of the macerator system. The macerator blade must be maintained in extremely close proximity to the filter screen, typically within about 0.060 inch from the screen. This spacing can be difficult to maintain due to such variables as machine manufacturing tolerances, normal wear of machine components, fluctuating operational conditions, and so forth.

U.S. Pat. No. 6,454,872 describes a system having a dual component shaft configuration between the motor drive shaft and chopper blade. The chopper blade is rotationally fixed to the filter screen and is detachably coupled to the motor drive shaft with a spring-biased coupling designed to accommodate axial tolerances of the drive shaft. This proposed solution, however, is relatively complex and introduces an additional point of potential mechanical failure (the coupling) between the motor shaft and chopper blade.

Accordingly, it would be desirable to provide a dishwasher with an improved macerator system that maintains the critical spacing between the chopper blade and filter screen in an effective and mechanically simple means.

BRIEF DESCRIPTION OF THE INVENTION

Aspects and advantages of the invention will be set forth in part in the following description, or may be obvious from the description, or may be learned through practice of the invention.

In an exemplary embodiment, a dishwasher is provided having a wash chamber that is supplied with wash water from a sump by a water circulation pump assembly. The pump assembly has an inlet in fluid communication with the sump and an outlet in fluid communication with the wash chamber. A macerator system is configured with the pump assembly and includes a filter screen disposed across the inlet and a chopper blade rotationally driven by the pump assembly at a defined axial distance spaced from the upstream side of the filter screen. The chopper blade is biased to the defined axial distance by materials in magnetic flux communication so as to maintain the precise distance in both a running and unpowered state of the pump assembly.

In a particular embodiment, the pump assembly includes a motor having a permanent magnet rotor (for example, a permanent magnet DC motor) that rotationally drives a drive shaft. The drive shaft passes through the filter screen, for example through a bearing mounted in the filter screen, and the chopper blade is mounted on the end of the drive shaft at the upstream side of the filter screen. The pump assembly further includes a motor casing with a biasing element disposed therein relative to the permanent magnet rotor such that a magnetic flux communication is established between the permanent magnet rotor and the biasing element that generates an axial biasing force on the rotor.

In one embodiment, the biasing element is disposed so as to generate an axial biasing force away from the inlet, and a stop is provided against which the chopper blade is biased. This stop defines the precise axial distance between the chopper blade and the filter screen. The stop may be, for example, the upstream side of the bearing mounted in the filter screen.

In yet another embodiment, the biasing element is disposed so as to generate an axial biasing force towards the inlet that is sufficient to prevent withdrawal of the drive shaft in an opposite axial direction upon depowering the pump assembly. A stop may also be provided against which the drive shaft is biased. This stop may be, for example, the downstream side of a bearing mounted in the filter screen against which a component mounted on the drive shaft is biased, such as the hub of the pump impeller.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
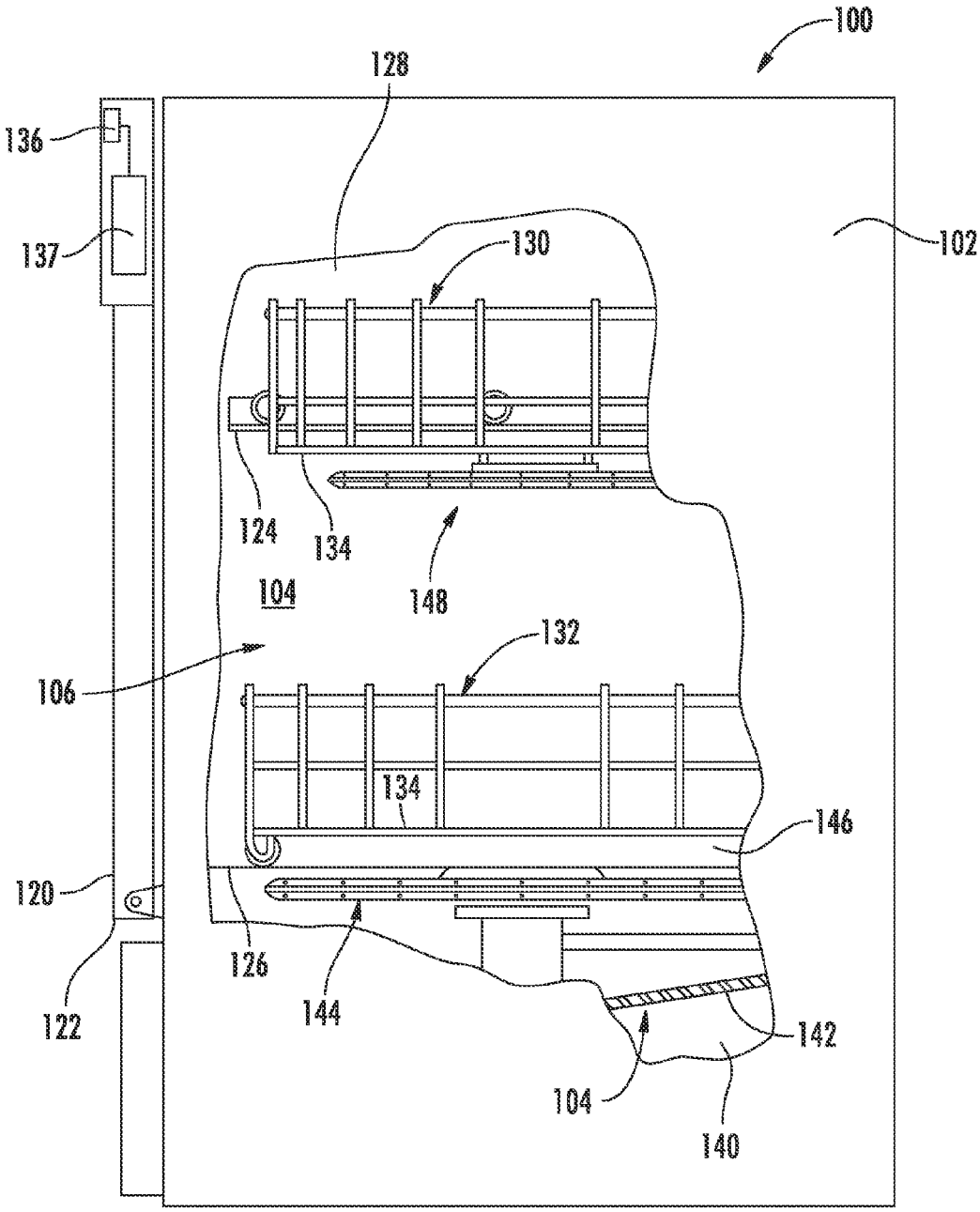
FIG. 1 is a side partial cut-away view of an exemplary dishwasher that may be configured in accordance with aspects of the invention.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As discussed in greater detail below, embodiments of the present invention relate to a dishwasher having an improved macerator system. FIG. 1 depicts an exemplary domestic dishwasher 100 that may be configured in accordance with aspects of the invention. It should be appreciated that the invention is not limited to any particular style, model, or configuration of dishwasher, and that the embodiment depicted in FIG. 1 is for illustrative purposes only.

The dishwasher 100 includes a cabinet 102 having a tub 104 therein that defines a wash chamber 106. The tub 104 includes a front opening having access through a door 120 hinged at its bottom 122 for movement between a normally closed vertical position (shown in FIG. 1) wherein the wash chamber 106 is sealed shut for washing operation, and a horizontal open position for loading and unloading of articles from the dishwasher. Upper and lower guide rails 124, 126 are mounted on tub side walls 128 and accommodate upper and lower roller-equipped racks 130, 132, respectively. In other exemplary dishwasher embodiments, the door 120 and attached racks slide into an out of the wash chamber 106 in a drawer-like configuration. Each of the upper and lower racks 130, 132 is fabricated into lattice structures including a plurality of elongate members 134, and each rack 130, 132 is adapted for movement between an extended loading position (not shown) in which the rack is substantially positioned outside the wash chamber 106, and a retracted position (shown in FIG. 1) in which the rack is located inside the wash chamber 106. A silverware basket (not shown) may be removably attached to the lower rack 132 for placement of silverware, utensils, and the like, that are too small to be accommodated by the upper and lower racks 130, 132.

The dishwasher 100 further includes a lower spray-arm-assembly 144 that is rotatably mounted within a lower region 146 of the wash chamber 106 and above a tub sump portion 142 so as to rotate in relatively close proximity to the lower rack 132. A mid-level spray-arm assembly 148 is located in an upper region of the wash chamber 106 and may be located in close proximity to upper rack 130. Additionally, an upper spray arm assembly (not shown) may be located above the upper rack 130.

The lower and mid-level spray-arm assemblies 144, 148 and the upper spray arm assembly are fed by a fluid circulation assembly for circulating water and dishwasher fluid in the tub 104. The fluid circulation assembly may be located in a machinery compartment 140 located below the bottom sump portion 142 of the tub 104, as generally recognized in the art. Each spray-arm assembly includes an arrangement of discharge jets or orifices for directing washing liquid onto dishes or other articles located in the upper and lower racks 130, 132, respectively. The arrangement of the discharge ports in at least the lower spray-arm assembly 144 provides a rotational force by virtue of washing fluid flowing through the discharge ports. The resultant rotation of the lower spray-arm assembly 144 provides coverage of dishes and other dishwasher contents with a washing spray.

The dishwasher 100 is further equipped with a controller 137 to regulate operation of the dishwasher 100. The controller may include a memory and microprocessor, such as a general or special purpose microprocessor operable to execute programming instructions or micro-control code associated with a cleaning cycle. The controller 137 may be positioned in a variety of locations throughout dishwasher 100. In the illustrated embodiment, the controller 137 may be located within a control panel area of door 120 and includes a user interface panel 136 through which a user may select various operational features and modes and monitor progress of the dishwasher 100.

Figure 2:
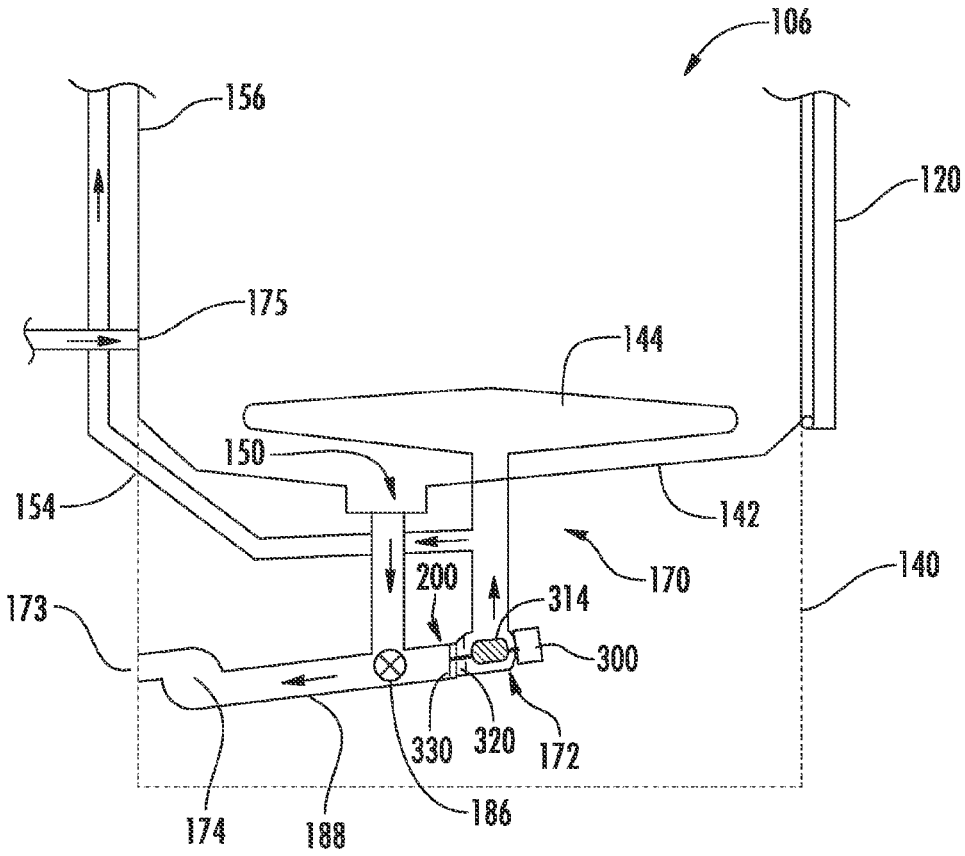
FIG. 2 is a diagram view of a typical dishwasher wash cycle system that includes a macerator at the inlet of the pump assembly.

FIG. 2 illustrates an embodiment of a fluid circulation assembly 170 configured below the wash chamber 106. Although one embodiment of a fluid circulation assembly that is operable to perform in accordance with aspects of the invention is shown, it is contemplated that other fluid circulation assembly configurations may similarly be utilized without departing from the spirit and scope of the invention. The fluid circulation assembly 170 includes a circulation pump assembly 172 and a drain pump assembly 174, both in fluid communication with the sump 150. Additionally, the drain pump assembly 174 is in fluid communication with an external drain 173 to discharge used wash liquid. Further, the circulation pump assembly 172 is in fluid communication with lower spray arm assembly 144 and conduit 154 which extends to a back wall 156 of wash chamber 106, and upward along the back wall 156 for feeding wash liquid to the mid-level spray arm assembly 148 (FIG. 1) and the upper spray arm assembly.

As wash liquid is pumped through the lower spray arm assembly 144, and further delivered to the mid-level spray arm assembly 148 and the upper spray arm assembly (not shown), washing sprays are generated in the wash chamber 106, and wash liquid collects in the sump 150. The sump 150 may include a cover to prevent larger objects from entering the sump 150, such as a piece of silverware or another dishwasher item that is dropped beneath lower rack 132. A course filter and a fine filter (not shown) may be located adjacent the sump 150 to filter wash liquid for sediment and particles of predetermined sizes before flowing into the sump 150. Furthermore, a turbidity sensor may be coupled to the sump 150 and used to sense a level of sediment in the sump 150 and to initiate a sump purge cycle where the contents or a fractional volume of the contents of the sump 150 are discharged when a turbidity level in the sump 150 approaches a predetermined threshold. The sump 150 is filled with water through an inlet port 175, as described in greater detail below.

In one embodiment, a drain valve 186 is established in flow communication with the sump 150 and opens or closes flow communication between the sump 150 and a drain pump inlet 188. The drain pump assembly 174 is in flow communication with the drain pump inlet 188 and may include an electric motor for pumping fluid at the inlet 188 to an external drain system via drain 173. In one embodiment, when the drain pump is energized, a negative pressure is created in the drain pump inlet 188 and the drain valve 186 is opened, allowing fluid in the sump 150 to flow into the fluid pump inlet 188 and be discharged from fluid circulation assembly 170 via the external drain 173.

Figure 3:
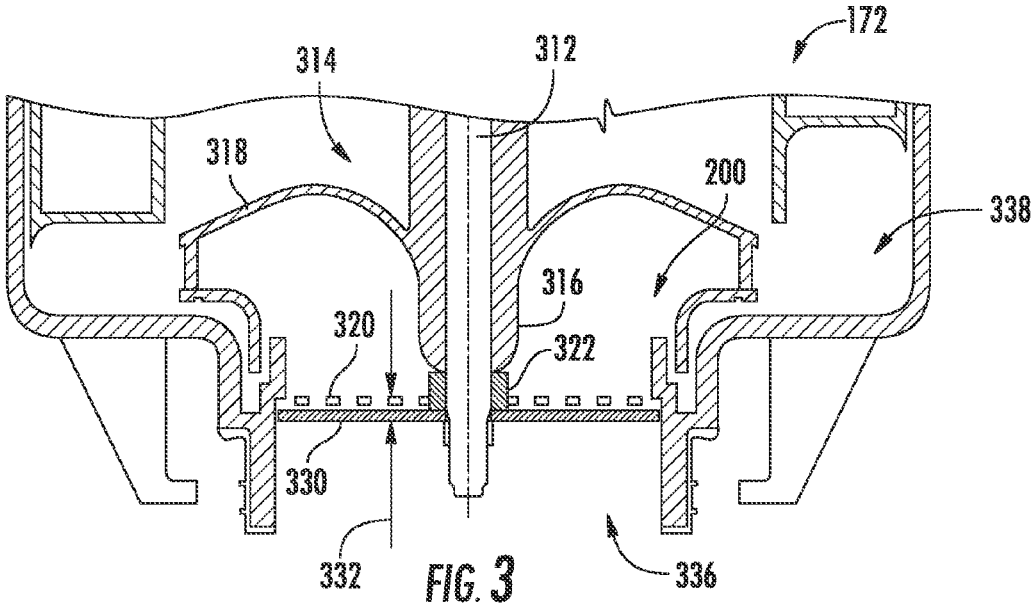
FIG. 3 is an enlarged partial cross-sectional view of the macerator system components, particularly illustrating the clearance between the chopper blade and filter screen.
Figure 4:
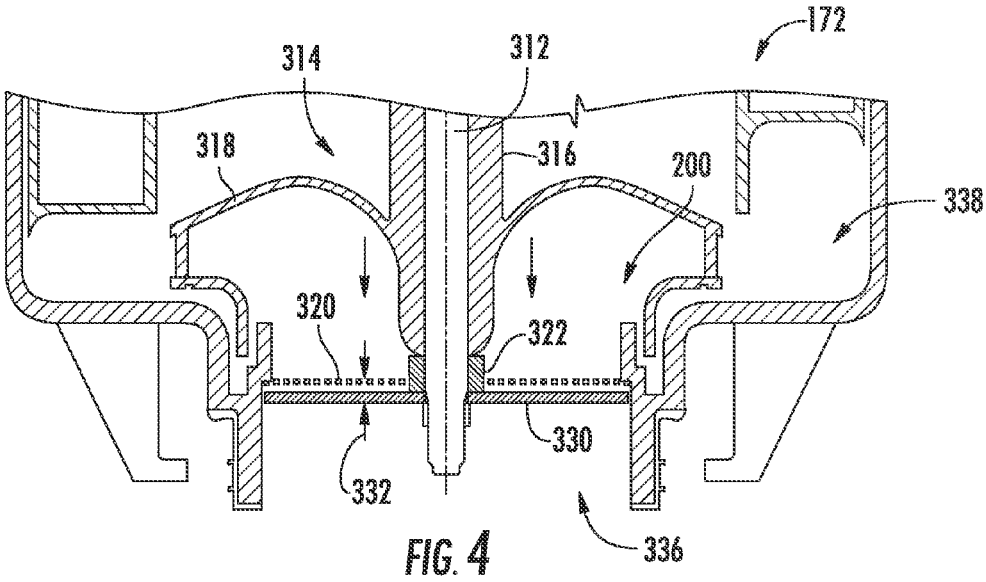
FIG. 4 is an enlarged partial cross-sectional view illustrating an increase in the spacing between the chopper blade and filter screen during operation of the pump assembly.

Referring to FIGS. 2 through 4, the pump assembly 172 includes a motor 300, an inlet 336 that is in communication with the sump 150, and an outlet 338 that discharges water to the wash chamber 146. The motor 300 drives an impellor 314 that is attached to a drive shaft 312. The drive shaft 312 may be a unitary drive shaft that is a component of the motor rotor 302 (FIG. 5), as discussed in greater detail below. The impellor 314 includes a hub 316 that is mounted to the drive shaft 312, as well as a plurality of impellor blades 318 that rotate within a pump chamber, as is commonly known.

Figure 5:
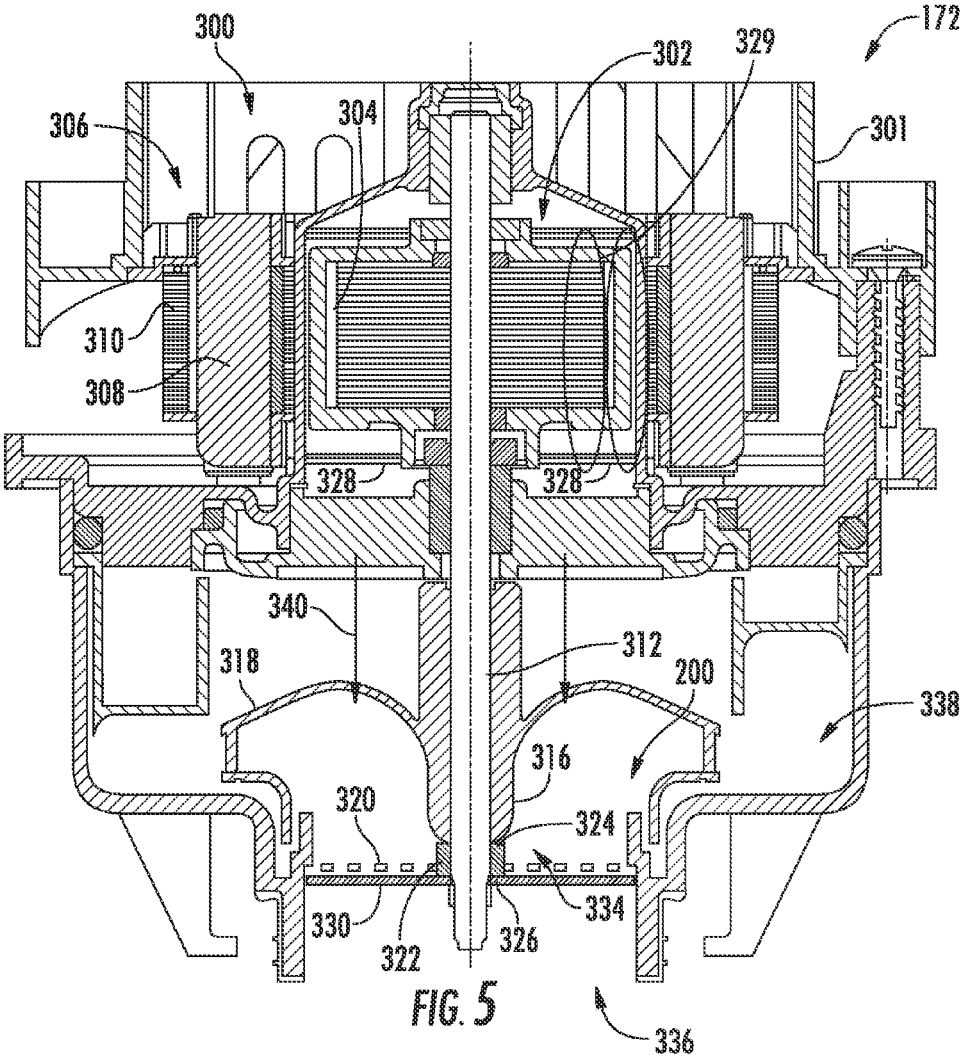
FIG. 5 is a cross-sectional view of a pump assembly having a magnetically biased permanent magnet rotor in accordance with aspects of the invention.

A filter screen 320 is disposed across the inlet 336. A chopper blade 330 is mounted on the drive shaft 312 and is spaced at a defined axial distance 332 upstream of the filter screen 320, as particularly illustrated in FIG. 3. As discussed above, the axial distance 332 between the chopper blade 320 and the cover screen 320 is an important consideration in the function and successful operation of the macerator system disposed at the inlet of the pump assembly 172. If the axial distance 332 is excessive, the pulverizing effect of the chopper blade 330 is significantly reduced to the extent that food (or other) particles can clog the filter screen 320 and choke off water flow to the pump assembly 172. On the other hand, a problem also exists with locating the chopper blade 330 in very close proximity to the filter screen 320. In particular, the drive shaft 312 to which the chopper blade 330 is mounted is part of the motor rotor and interacts with the motor stator 306 (FIG. 5). Such motors have an inherent relative axial movement of the rotor 304 and relative to the stator 306 between a non-powered and powered state of the motor wherein axial movement of the rotor 304 (and attached drive shaft 312) occurs that may be, for example, in the range of about 0.125 to about 0.187 inch. When the pump assembly 172 is actuated and the motor 300 is energized, the impellor 314 generates a "helicopter" lift effect as it rotates and pulls water through the inlet 336 causing the entire rotor 304 to pull forward towards the inlet 336. This condition is illustrated in FIG. 4 wherein it can be readily seen that the axial distance 332 between the chopper blade 330 and filter screen 320 is significantly greater than the desired distance 332 depicted in FIG. 3. On the other hand, when the pump assembly 172 is turned off (unpowered), the rotor 304 retracts slightly back into the pump assembly 172 with loss of the helicopter lift effect.

The above described phenomenon is problematic in that the relative axial movement of the rotor 304 (and attached chopper blade 330) must be accounted for. If the desired axial distance 332 between the chopper blade 330 and filter screen 320 is to be less than, for example, 0.060 inch (preferably about 0.030 inch) in the running operational state of the pump assembly 172, then such distance cannot accommodate the significantly greater withdraw distance of the rotor when the pump is shut off. Withdraw of the rotor in this condition would cause the chopper blade 330 to impinge against the filter screen 320. Upon a subsequent startup, this impingement would likely create a locked-rotor condition and possibly burn out the motor. The macerator system 200 in accordance with the present invention allows for precise location of the chopper blade 330 relative to the filter screen 320 without having to accommodate for relative axial movement between the rotor 304 (and drive shaft 312) and motor stator 306.

Figure 6:
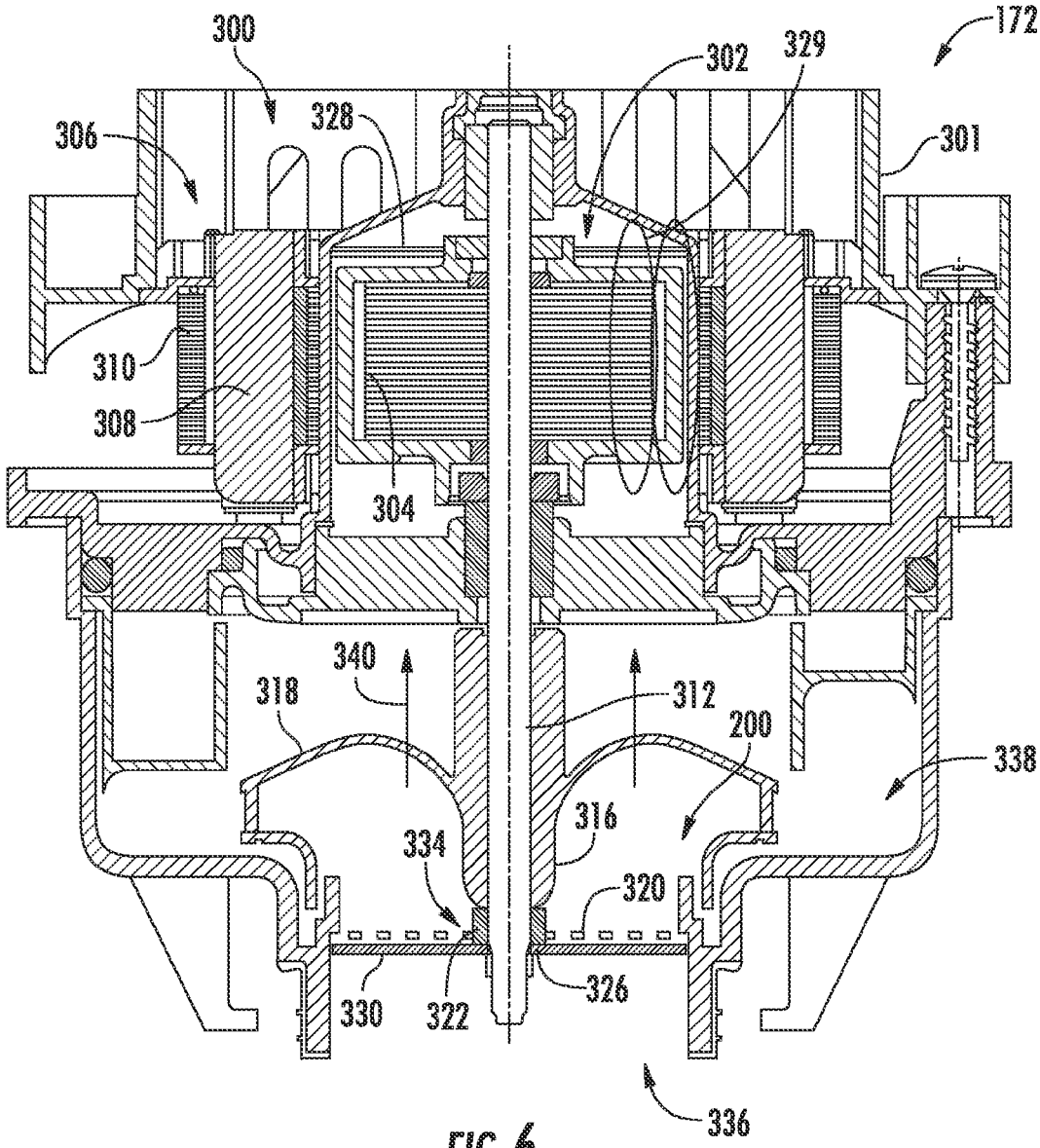
FIG. 6 is a cross-sectional view of an alternate embodiment of a pump assembly in accordance with the invention.

Referring to FIGS. 5 and 6, the pump assembly 172 is shown in greater detail. Pump assembly 172 includes a motor 300 having a rotor with permanent magnets 304 configured therewith. Various types of suitable motors 300 utilizing a permanent magnet rotor 304 are well known in the industry. For example, a brushless DC motor is a well-known type of permanent magnet motor. These motors are also known as "electronically commutated motors" (ECM). These motors are synchronous electric motors powered by direct-current (DC) and have an electronic commutation system rather than mechanical commutators and brushes. Another type of motor 300 having a permanent-magnet rotor 304 is any manner of various AC synchronous motors. It should be readily appreciated that the present invention is not limited to any particular type of motor 300 that utilizes the aspects and advantages of the invention. FIGS. 5 and 6 merely depict an exemplary motor having a rotor 302 with permanent magnets 304 disposed radially outward of laminate sheets with inherent magnetic field lines 329. This magnetic field interacts with a rotating field induced in the stator 306 by windings 310 provided on a core 308, as is well known to those skilled in the art.

A biasing force generated by materials in magnetic flux communication indicated by the lines 304 in FIGS. 5 and 6 is induced on the rotor 302 so that the chopper blade 330 is biased to the defined axial distance 332 (FIG. 3) in the running and stopped states of the pump assembly 172. The magnetic biasing force 340 is generated by taking advantage of the presence of the permanent magnets 304 in the motor rotor 302. In the embodiment depicted in FIG. 5, biasing elements 328 are disposed within the motor housing 301 at a location upstream (towards the inlet 336) of the permanent magnets 304. These biasing elements 328 may be, for example, steel or other iron-containing metal plates, inserts, and the like disposed around the shaft 312 at an axial distance from the permanent magnets 304. The biasing elements may also be any manner of metalized component, such as a metalized plastic component that may define a portion of the motor housing 301.

The magnetic flux communication established between the permanent magnets 304 and the stationarily-mounted biasing elements 328 generate the biasing force 340 that draws the rotor 302 towards the biasing elements 328, as indicated by the arrows in FIG. 5. Thus, a biasing force is transmitted through the components to the chopper blade 330 that is mounted at the end of the shaft 312. This biasing force 340 is sufficient to prevent withdrawal of the rotor 320 in the opposite axial direction (upstream direction) when the pump assembly 172 is shut off. Thus, the biasing force 340 prevents the chopper blade 330 from impinging against the filter screen 320 in the unpowered state of the motor 300. Accordingly, the problematic withdrawal distance that needed to be accommodated for in prior art configurations is not a concern with the configuration of FIG. 5 in accordance with aspects of the invention.

Any manner of stop 334 may be provided to interact with the chopper blade 330 to maintain the defined axial distance 332 between the blade 330 and filter screen 320. In the illustrated embodiment, the shaft 312 passes through a bearing 322 that is mounted in the filter screen 320. This bearing 322 may be machined or otherwise formed with precise axial dimensions and mounted within the filter screen 320 in such a manner that the downstream face 324 and upstream face 326 serve as precisely-defined stops to maintain the axial distance 332 of the chopper blade 330 relative to a filter screen 320 depending on the direction of the magnetically induced biasing force 340. For example, in the embodiment of FIG. 5, the biasing elements 328 generate the biasing force 340 on the rotor 302 towards the inlet 336 of the pump assembly. In this configuration, the bottom of the impellor hub 316 may bear against the upstream face 324 of the bearing 332 in the running state of the motor 300. When the motor 300 is shut down, the biasing force 340 prevents withdrawal of the rotor 302 back towards the stator 306. Thus, because the withdrawal distance need not be compensated for, the downstream face 326 of the bearing 322 may be utilized to set the axial distance 332 (FIG. 3) between the chopper blade 330 and filter screen 320 in all states of the pump assembly 172.

In the embodiment illustrated in FIG. 6, the biasing elements 328 are located at the opposite axial end of the rotor 302 within the housing 301. Thus, the biasing force 340 is in the opposite axial direction, thereby biasing the rotor 302 towards the stator 306 in all states of the motor 300. This configuration negates the "helicopter affect." Thus, a precisely defined axial distance 332 (FIG. 3) between the chopper blade 330 and filter screen 320 can be maintained by biasing the chopper blade 330 against the upstream face 326 of the bearing 322 in all states of the pump assembly 172. The blade 330 will not drift away from the screen 320 during operation of the pump assembly 172, unlike the condition illustrated in FIG. 4.

The embodiment of FIG. 6 has additional benefits in that in the event that relatively large particles are drawn against the filter screen 320, the blade 330 will ride up and over the particles until the particles are eventually pulverized by the blade. The biasing force 340 allows the chopper blade 330 to intermittently ride over the large particles (at an increased axial system 332) while continuously biasing the blade 330 in a direction towards the upstream side 326 of the bearing 322. Once the larger particles have been pulverized or passed through the screen 320, the blade 330 is again biased against the bearing 322 at the precisely defined axial distance 332.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwasher, comprising:

a wash chamber;

a sump;

a water circulation pump assembly having a motor, an inlet in fluid communication with said sump, and an outlet in fluid communication with said wash chamber, the motor comprising a permanent magnet rotor;

a macerator system configured with said pump assembly, said macerator system comprising a filter screen disposed across said inlet and a chopper blade rotationally driven by said permanent magnet rotor at a defined axial distance upstream from said filter screen;

a biasing member axially positioned with respect to said permanent magnet rotor; and said chopper blade biased to said defined axial distance by said biasing member in magnetic flux communication with said permanent magnet rotor so as to maintain said defined axial distance in a running and stopped states of said pump assembly.

2. The dishwasher as in claim 1, wherein said permanent magnet rotor rotationally drives a drive shaft, said drive shaft passing through said filter screen, said chopper blade mounted on an end of said drive shaft at an upstream side of said filter screen, said pump assembly further comprising a motor casing with said biasing element disposed therein in magnetic flux communication with said permanent magnet rotor such that a magnetic flux communication bias between said permanent magnet rotor and said biasing element generates an axial biasing force on said rotor.

3. The dishwasher as in claim 2, wherein said biasing element is disposed so as to generate an axial biasing force away from said inlet, and further comprising a stop against which said chopper blade is biased, said stop defining said axial distance between said chopper blade and said filter screen.

4. The dishwasher as in claim 3, further comprising a bearing mounted to said filter screen, said drive shaft passing through said bearing, an upstream side of said bearing defining said stop.

5. The dishwasher as in claim 2, wherein said biasing element is disposed relative to said permanent magnet rotor so as to generate an axial biasing force towards said inlet that is sufficient to prevent withdrawal of said drive shaft in an opposite axial direction upon depowering said pump assembly.

6. The dishwasher as in claim 5, further comprising a stop against which said drive shaft is biased.

7. The dishwasher as in claim 6, further comprising a hearing mounted to said filter screen, said drive shaft passing through said bearing, said hearing defining a downstream side that defines said stop.

8. The dishwasher as in claim 7, wherein said pump assembly further comprises an impeller mounted to said drive shaft downstream of said filter screen, said impeller biased against said downstream side of said bearing.

9. The dishwasher as in claim 2, wherein said drive shaft is a unitary shaft from said rotor to said chopper blade.

10. The dishwasher as in claim 1, wherein said permanent magnet rotor is a brushless DC permanent magnet motor.

* * * * *